US006113228A

United States Patent [19]

Pawlowski, Jr. et al.

[11] Patent Number: 6,113,228

[45] **Date of Patent: *Sep. 5, 2000**

[54] INK CONTAINER FOR COMPACT SUPPLY STATION

[75] Inventors: Norman E. Pawlowski, Jr., Corvallis; Eric L. Gasvoda, Salem, both of Oreg.

[73] Assignee: Hewlett-Packard Company, Palo Alto, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 09/144,537

[22] Filed: Aug. 31, 1998

Related U.S. Application Data

[63] Continuation-in-part of application No. 08/868,927, Jun. 4, 1997.

[51] Int. Cl.[7] ..... B41J 2/175

[52] U.S. Cl. ..... 347/81

[58] Field of Search ..... 347/85, 86, 87

[56] References Cited

U.S. PATENT DOCUMENTS

| | | | |
|---|---|---|---|
| 3,941,171 | 3/1976 | Ogle | 141/309 |
| 4,432,005 | 2/1984 | Duffield et al. | 247/86 |
| 4,496,959 | 1/1985 | Frerichs | 347/86 |
| 4,558,326 | 12/1985 | Kimura et al. | 347/30 |
| 4,568,954 | 2/1986 | Rosback | 347/86 |
| 5,270,219 | 12/1993 | DeCastro et al. | 436/180 |
| 5,506,611 | 4/1996 | Ujita et al. | 347/86 |
| 5,552,815 | 9/1996 | Shimoda | 347/85 |
| 5,583,549 | 12/1996 | Ujita et al. | 347/86 |
| 5,732,751 | 3/1998 | Schmidt et al. | 141/48 |
| 5,777,646 | 7/1998 | Barinaga et al. | 347/86 |
| 5,825,387 | 10/1998 | Cowger et al. | 347/86 |

FOREIGN PATENT DOCUMENTS 5-318760 12/1993 Japan .

*Primary Examiner*—N. Le
*Assistant Examiner*—Michael Nghiem
*Attorney, Agent, or Firm*—Kevin B. Sullivan

[57] ABSTRACT

The present disclosure relates to an ink container for providing ink to an ink jet printing system. The ink container includes an outer shell, the outer shell defining an elongate opening therein. Also included is a chassis having a fluid outlet and air inlet defined therein. The fluid outlet is in communication with an ink reservoir that is fluidically coupled to the chassis. The chassis has a shape that is complementary with the elongate opening of the outer shell. With the chassis inserted into the outer shell pressurized air provided at the air inlet pressurizes the outer shell that in turn pressurizes the ink reservoir to provide a source of pressurized ink at the fluid outlet.

10 Claims, 12 Drawing Sheets

INK CONTAINER FOR COMPACT SUPPLY STATION

CROSS-REFERENCE TO RELATED APPLICATION

This application is a continuation-in-part of U.S. patent application Ser. No. 08/868,927, filed on Jun. 4, 1997, attorney docket number 10970430-1, entitled "*An Ink Container Having a Multiple Function Chassis*" assigned to the assignee of the present invention and incorporated herein by reference.

BACKGROUND OF THE INVENTION

The present invention relates to ink-jet printing systems, and more particularly, ink-jet printing systems that make use of ink containers that are replaceable separate from a printhead.

Ink-jet printers frequently make use of an ink-jet printhead mounted to a carriage which is moved back and fourth across a print media, such as paper. As the printhead is moved across the print media, a control system activates the printhead to deposit ink droplets onto the print media to form images and text.

Previously used printers have made use of an ink container that is separably replaceable from the printhead. When the ink cartridge is exhausted the ink cartridge is removed and replaced with a new ink container. The use of replaceable ink containers that are separate from the printhead allow users to replace the ink container without replacing the printhead. The printhead is then replaced at or near the end of printhead life and not when the ink container is exhausted.

There is an ever-present need for printing systems that are capable of providing low operating costs such as printers that make use of off-axis type ink supplies. In addition, these printing systems should be easy to operate, such as, including some form of memory for storing printing parameters so that the user is not required to adjust printer parameters when the ink container is replaced. These ink supplies should be capable of reliable insertion into the printing system to ensure proper fluid interconnection and proper electrical interconnection once properly installed. In addition, these interconnections should be reliable and should not degrade over time and use. For example, the fluid interconnect should not leak during use or over time and the electrical interconnect should be reliable during use and over time. In addition, these ink cartridges should not require special handling by the user and should be reliable and easily connected by the user to form a positive highly reliable mechanical, electrical, and fluid interconnect with the printer.

These ink containment systems should be capable of providing ink at high flow rates to a printhead thereby allowing high throughput printing. This ink supply system should be cost effective to allow relatively low cost per page printing. In addition, the ink supply should be capable of providing ink at high flow rates in a reliable manner to the printhead.

The electrical interconnection between the ink container and printer should be reliable without requiring relatively large contact force. The use of relatively large contact force tends to improve the reliability of the electrical interconnect. Large contact force interconnects tend to require increased latch and insertion forces which tend to result in increased costs due to higher force latch springs and larger latching surfaces. Therefore, the electrical interconnect should be capable of providing high reliability and requiring relatively low interconnect forces.

Finally, the ink containers should be relatively compact so that the space required for the ink container receiving station is not too large. Color printing systems usually print four colors such as cyan, yellow, magenta and black. In the case of high fidelity printing, these systems often make use of seven or more colors. As larger numbers of ink colors are required it becomes even more important that each individual ink container be compact or make efficient use of space to limit the size of the ink container receiving station.

Compact ink containers also better suited for smaller format printers. For example, printers that print on smaller sized media are more compact and therefore require more compact ink containers for a smaller ink container receiving station. In addition, these smaller format printers typically use ink at a lower use rate than the larger format printers and therefore do not require as large an ink supply as the larger format printers.

SUMMARY OF THE INVENTION

The present disclosure relates to an ink container for providing ink to an ink jet printing system. The ink container includes an outer shell, the outer shell defining an elongate opening therein. Also included is a chassis having a fluid outlet and air inlet defined therein. The fluid outlet is in communication with an ink reservoir that is fluidically coupled to the chassis. The chassis has a shape that is complementary with the elongate opening of the outer shell. With the chassis inserted into the outer shell pressurized air provided at the air inlet pressurizes the outer shell that in turn pressurizes the ink reservoir to provide a source of pressurized ink at the fluid outlet.

Another aspect of the present invention is a method for forming an ink container having an outer shell that defines an opening therein and a chassis. The chassis is configured to form a seal with the opening. The method includes injection molding a preform to have an elongate profile along an axis of elongation. Also included is blow molding the injection molded preform to form the outer shell of the ink container so that the opening of the outer shell has the elongate profile defined in the injection molding.

Yet another aspect of the present invention is similar to the above method except that instead of injection molding the preform extrusion molding is used to form the preform so that the opening of the outer shell has the elongate profile.

DETAILED DESCRIPTION OF THE PREFERRED EMBODIMENT

Figure 1:
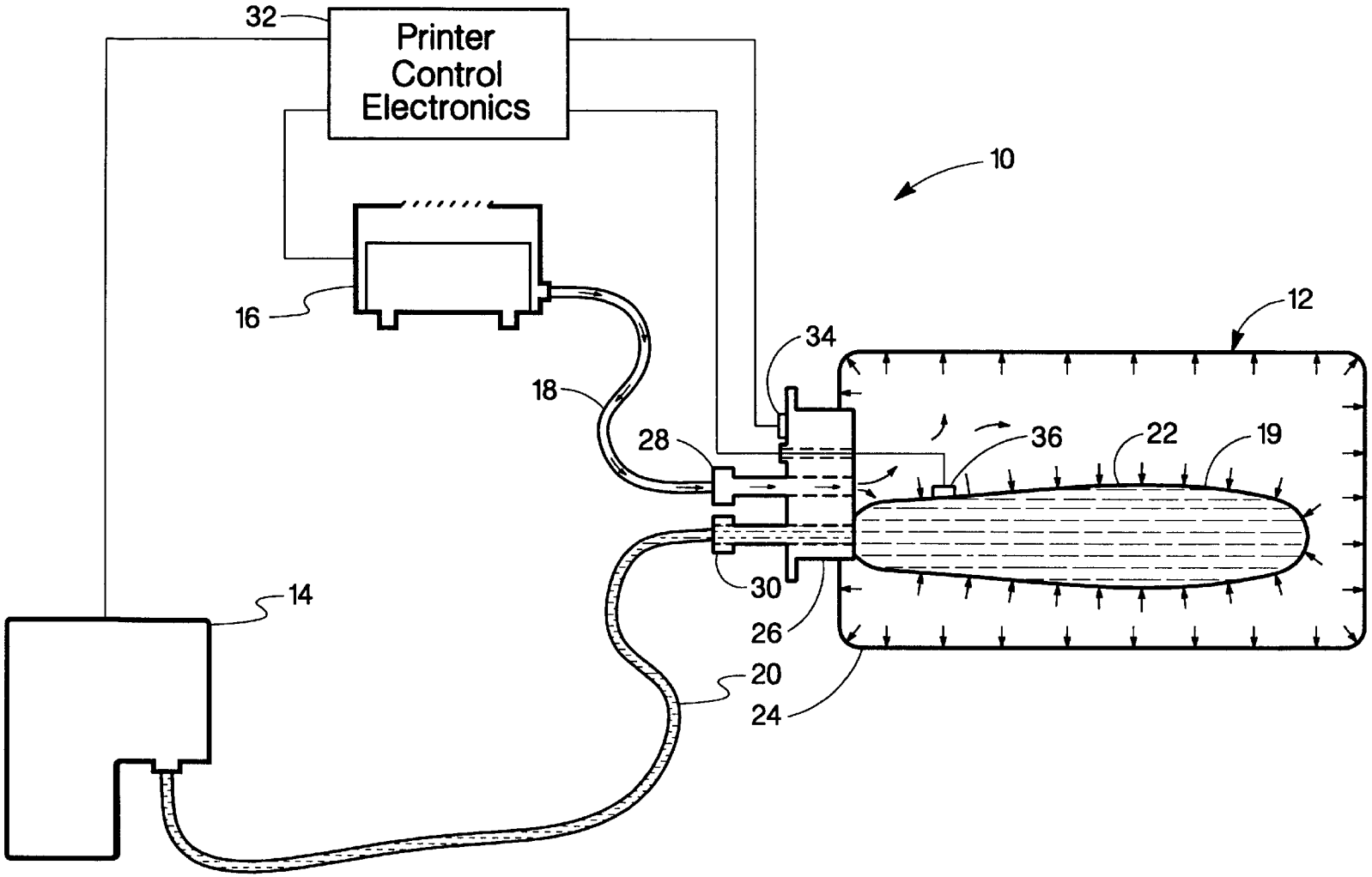
FIG. 1 depicts a schematic representation of a printing system that includes an ink container of the present invention.

FIG. 1 depicts a schematic representation of a printing system 10 that includes the ink container 12 of the present invention. Also included in the printing device 10 is a printhead 14 and a source of pressurized gas such as a pump 16. The pump 16 is connected by a conduit 18 for providing a pressurized gas such as air to the ink container 12. A marking fluid 19 such as ink is provided by the ink container 12 to the printhead 14 by a conduit 20. This marking fluid is ejected from the printhead 14 to accomplish printing.

The ink container 12 which is the subject of the present invention includes a fluid reservoir 22 for containing ink 19, an outer shell 24, and a chassis 26. In the preferred embodiment the chassis 26 includes an air inlet 28 configured for connection to conduit 18 for pressurizing the outer shell 24 with air. A fluid outlet 30 is also included in the chassis 26. The fluid outlet 30 is configured for connection to the conduit 20 for providing a fluid connection between the fluid reservoir 22 and fluid conduit 20.

In the preferred embodiment the fluid reservoir 22 is formed from a flexible material such that pressurization of the outer shell produces a pressurized flow of ink from the fluid reservoir 22 through the conduit 20 to the printhead 14. The use of a pressurized source of ink in the fluid reservoir 22 allows for a relatively high fluid flow rates from the fluid reservoir 22 to the printhead 14. The use of high flow rates or high rates of ink delivery to the printhead make it possible for high throughput printing by the printing system 10.

The ink container 12 also includes a plurality of electrical contacts, as will be discussed in more detail with respect to FIG. 3. The electrical contacts provide electrical connection between the ink container 12 and printer control electronics 32. The printer control electronics 32 controls various printing system 10 functions such as, but not limited to, printhead 14 activation to dispense ink and activation of pump 16 to pressurize the ink container 12. In one preferred embodiment the ink container 12 includes an information storage device 34 and an ink level sensing device 36. The information storage device 34 provides information to the printer control electronics 32 for controlling printer 10 parameters such as ink container 12 volume as well as ink characteristics, to name a few. The ink level sense device 36 provides information relating to current ink volume in the ink container 12 to the printer control electronics 32.

Figure 2:
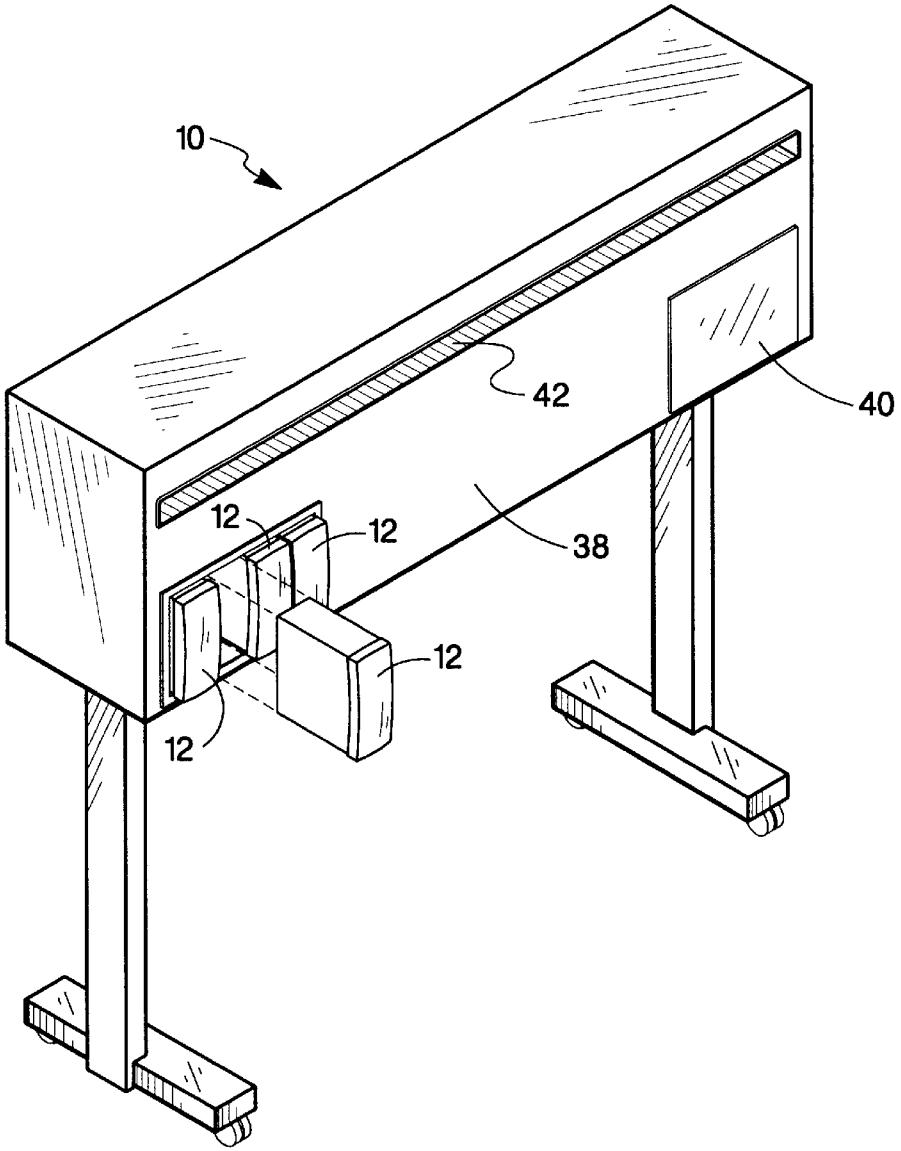
FIG. 2 depicts a perspective view of a representation of the printing system of FIG. 1.

FIG. 2 depicts one embodiment of the printing system 10 shown in perspective. The printing system 10 includes a printing chassis 38 containing one or more ink container 12 of the present invention. The embodiment shown in FIG. 2 is shown having four similar ink containers 12. In this embodiment, each ink container contains a different ink color. Therefore, four color printing is accomplished by providing cyan, yellow, magenta and black ink from the four ink containers 12 to one or more printheads 14. Also included in the printer chassis 38 is a control panel 40 for controlling operation of the printer 10 and a media slot 42 from which print media such as paper is ejected.

As ink 19 in each ink container 12 is exhausted the ink container 12 is replaced with a new ink container 12 containing a new supply of ink. In addition, the ink container 12 may be removed from the printer chassis 38 for reasons other than an out of ink condition such as changing inks for an application requiring different ink properties or for use on different media. It is important that the ink container 12 be not only accessible within the printing system 10 but also easily replaceable. It is also important that the replacement ink container 12 form reliable electrical connection with corresponding electrical contacts associated with the printer chassis 38 as well as properly form necessary interconnects such as fluid interconnect, air interconnect and mechanical interconnect so that the printing system 10 performs reliably. The present invention is directed to an ink container 12 that is configured to reliably engage corresponding interconnects associated with the printer chassis 38.

It is important that ink spillage and spattering be minimized to provide reliable interconnection between the ink container 12 and printer 10. Ink spillage is objectionable not only for the operator of the printer who must handle the spattered ink container 12 but also from a printer reliability standpoint. Inks used in ink-jet printing frequently contain chemicals such as surfactants which if exposed to printer components can effect the reliability of these printer components. Therefore, ink spillage inside the printer can reduce the reliability of printer components thereby reducing the reliability of the printer.

The present invention is a method and apparatus for forming a compact ink container 12 that is well suited to printers having limited space for an ink container receiving station. Before discussing the details of the present invention it will be helpful to first discuss the embodiment of the ink container 12 discussed in Ser. No. 08/868,927 shown in FIGS. 3, 4, 5A, 5B, 6, and 7 to compare similarities and differences with the ink container 12 of the present invention discussed with respect to FIGS. 8, 9A, 9B, 10, 11, 12, and 13.

Figure 3:
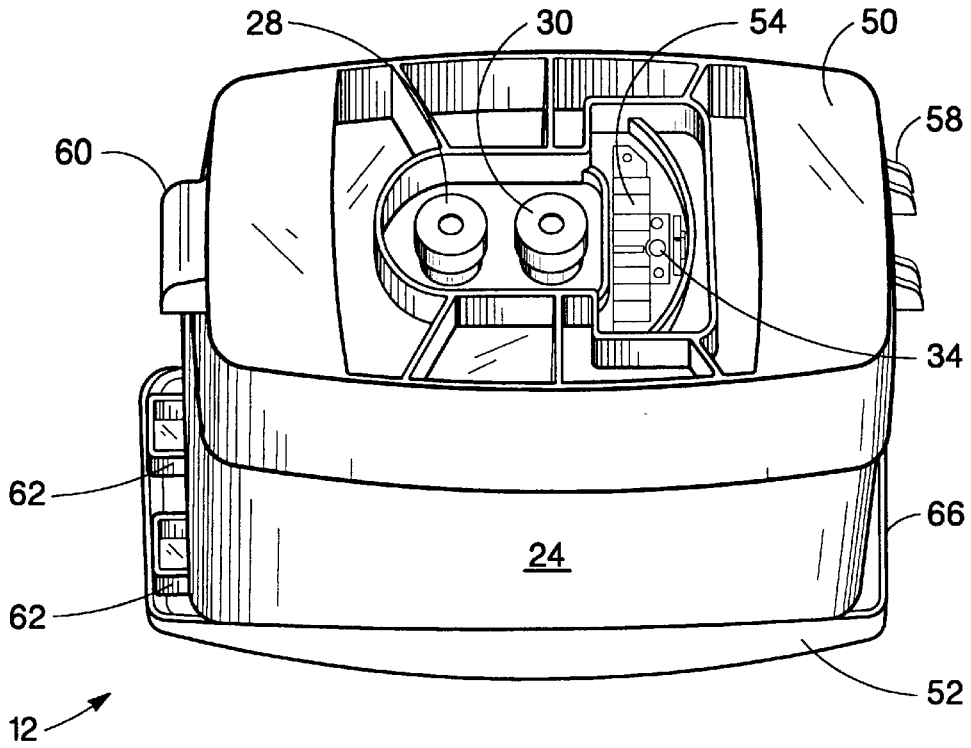
FIG. 3 depicts a perspective view of a leading edge portion of one embodiment of the ink container of the present invention.
Figure 4:
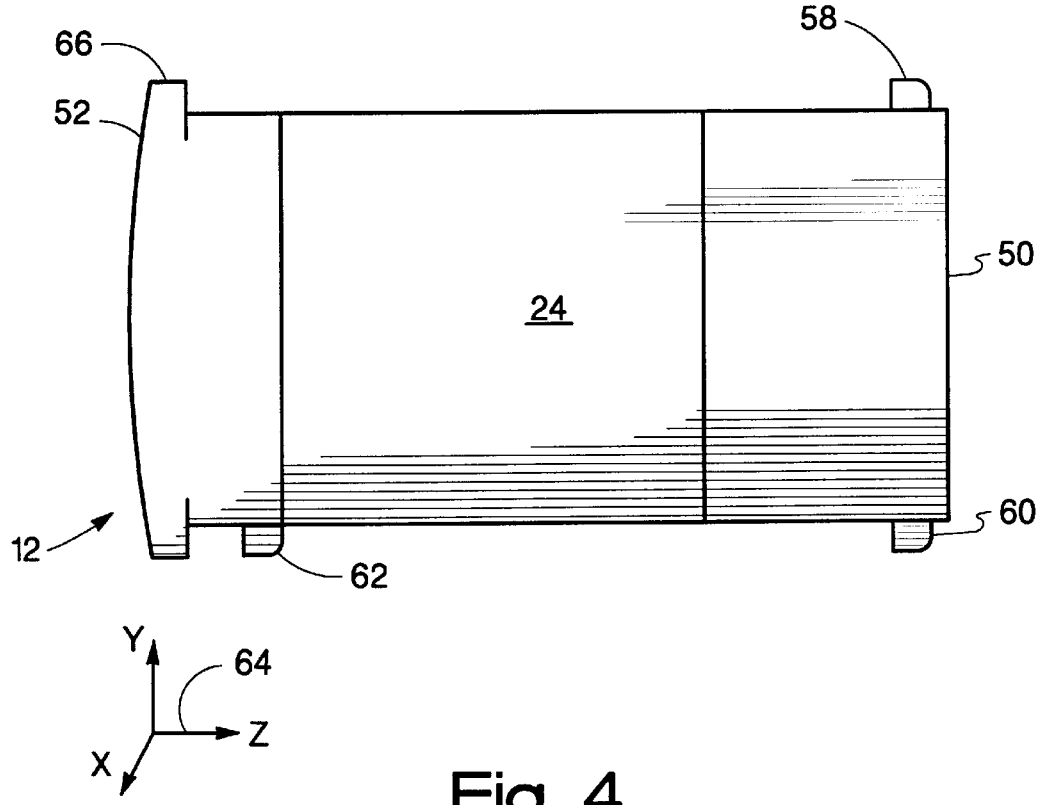
FIG. 4 depicts a side plan view of the ink container shown in FIG. 3.

FIGS. 3 and 4 depict the ink container 12 discussed in Ser. No. 08/868,927. The ink container 12 includes a housing or outer shell 24 which contains the fluid reservoir 22 shown in FIG. 1 for containing ink 19. The outer shell 24 has a leading edge 50 and trailing edge 52 relative to a direction of insertion for the ink container 12 into the printer chassis 38. The leading edge 50 includes the air inlet 28 and the fluid outlet 30 which are configured for connection to the air pump 16 and the printhead 14, respectively, once the ink container 12 is properly inserted into the printer chassis 38.

A plurality of electrical contacts 54 are disposed on the leading edge 50 for providing electrical connection between the ink container 12 and printer control electronics 32. In one preferred embodiment the plurality of electrical contacts 54 include a first plurality of electrical interconnects that are electrically interconnected to the information storage device 34 and a second plurality of electrical interconnects which are electrically interconnected to the ink volume sensor 36 shown in FIG. 1. In the preferred embodiment the information storage device 34 is a semiconductor memory and the ink volume sensing device 36 is an inductive sensing device.

The electrical contacts 54 will be discussed in more detail with respect to FIG. 6.

The ink container 12 includes one or more keying and guiding features 58 and 60 disposed toward the leading edge 50 of the ink container 12. The keying and guiding features 58 and 60 work in conjunction with corresponding keying and guiding features on the printer chassis 38 to assist in aligning and guiding the ink container 12 during insertion of the ink container 12 into the printer chassis 38. The keying and aligning features 58 and 60 in addition to providing a guiding function also provide a keying function to insure only ink containers 12 having proper ink parameters such as proper color and ink type are inserted into a given slot of printer chassis 38. Keying and guiding features are discussed in more detail in co-pending patent application Ser. No. 08/566,521 filed Dec. 4, 1995 entitled "Keying System for Ink Supply Containers" assigned to the assignee of the present invention and incorporated herein by reference.

A latch feature 62 is provided toward the trailing edge 52 of the ink container 12. The latch feature 62 works in conjunction with corresponding latching features on the printer portion to secure the ink container 12 within the printer chassis 38 such that proper interconnects such as pressurized air, fluidic and electrical are accomplished in a reliable manner. The latching feature 62 is a molded tang, which extends downwardly relative to a gravitational frame of reference. The ink container 12 shown in FIG. 4 is positioned for insertion into a printer chassis 38 along the Z-axis of coordinate system 64. The ink container 12 when inserted into the printer chassis 38 has gravitational forces acting on the ink container 12 along the Y-axis.

Figure 5A:
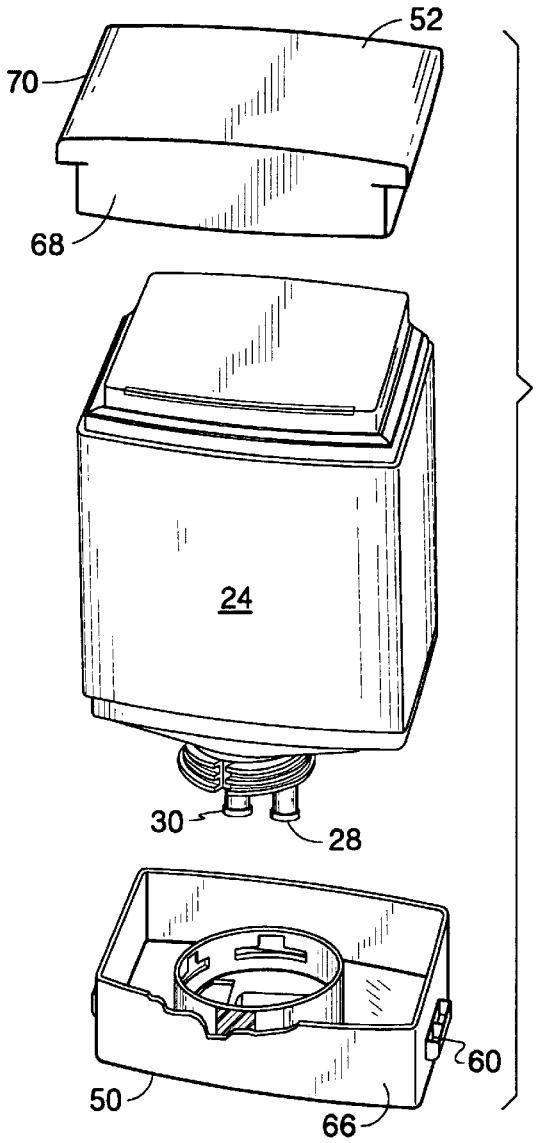
FIGS. 5A and 5B depicts a partially exploded view shown in perspective of the ink contain shown in FIG. 3.
Figure 5B:
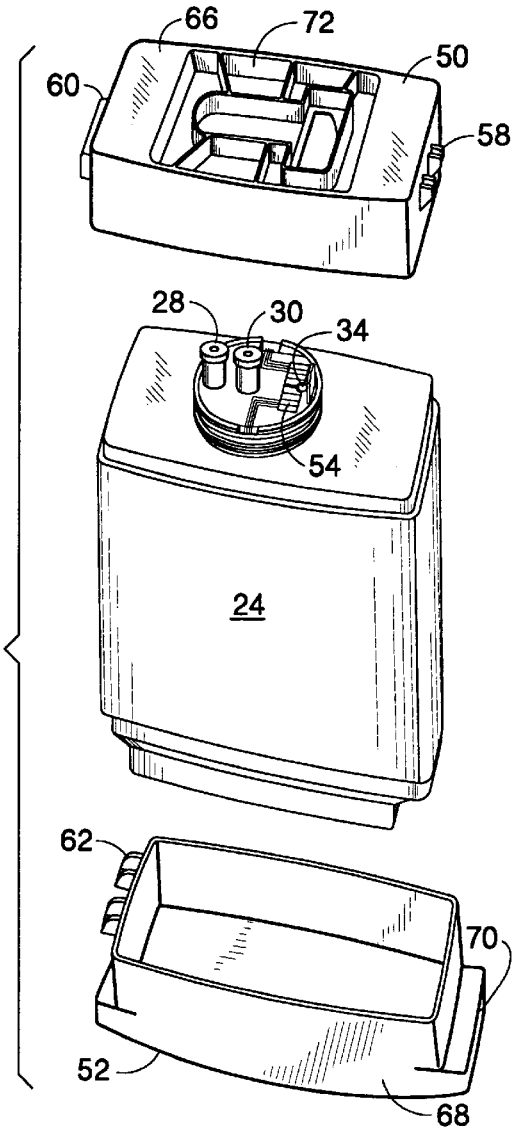

FIGS. 5A and 5B depict a partially exploded view of the ink container 12 shown in FIGS. 3 and 4. The ink container 12 in FIG. 5A is oriented such that the trailing edge 52 is oriented upwards. The ink container 12 in FIG. 5B is oriented in the opposite direction such that the leading edge 50 is oriented upwards. The ink container 12 includes a leading end cap 66 disposed on at the leading edge 50 of the ink container 12 and trailing end cap 68 disposed at the trailing edge 52 of the ink container 12. Each of the leading end caps 66 and the trailing end caps 68 include features for securing the ink container 12 within the printer chassis 38. The trailing end cap 68 includes the latch feature 62 for securing the ink container within the printer chassis 38. The trailing end cap 68 also includes an oversized end portion 70 that prevents backward insertion of the ink container 12 into the printer chassis 38.

The leading end cap 66 includes a boss 72 for protecting the air inlet 28, the fluid outlet 30, the information storage device 34, and the electrical contacts 54. In addition, the leading end cap 68 includes keying and guiding features 58 and 60 that work in conjunction with corresponding keying and guiding features on the printer chassis 38 to assist in aligning and guiding the ink container during insertion of the ink container 12 into the printer chassis 38.

Figure 6:
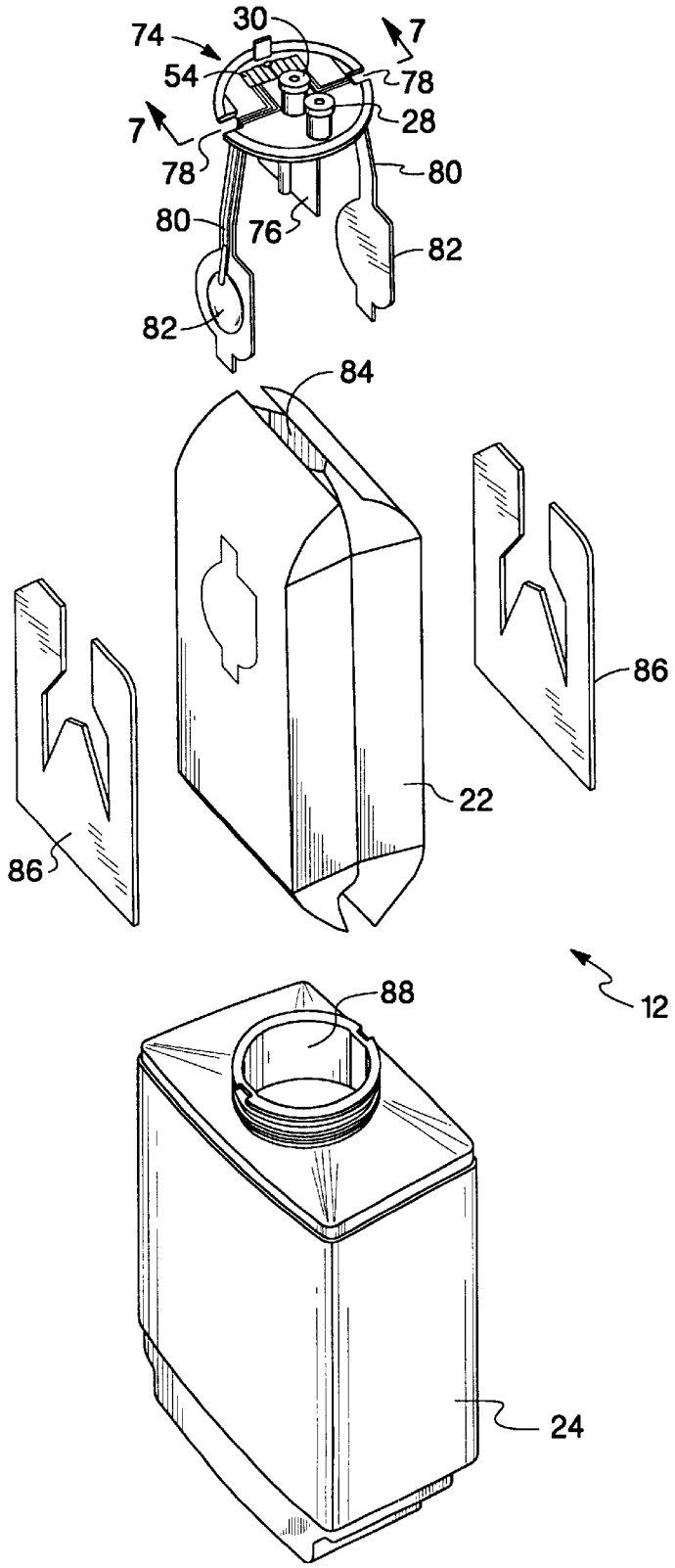
FIG. 6 depicts an exploded view shown in perspective of the ink container shown in FIG. 3.

FIG. 6 depicts an exploded view of the ink container 12 shown without the leading end cap 66 and the trailing end cap 68. The ink container 12 includes a chassis 74 that includes a tower-shaped air inlet 28, a tower-shaped fluid outlet 30, the information storage device 34, the plurality of electrical contacts 54, and a keel shaped attachment surface 76. An electrical pathway 78 is attached to the chassis 74 that allows the routing of electrical conductors 80 between electrical contacts 54 and a sensor 82. The attachment surface 76 of the chassis 74 is configured to be received in an opening 84 in the ink reservoir 22. In the preferred embodiment, the ink reservoir 22 is a pleated bag that is attached to the attachment surface 76 to form a seal between the ink reservoir 22 and the chassis 74. Fluid communication is established between the fluid outlet 30 and the ink reservoir 22 through the chassis 74. Stiffeners 86 are attached to the ink reservoir 22 to provide a more controlled collapse of the reservoir 22. In the preferred embodiment the sensor 82 measures a separation between sidewalls of the ink reservoir 22. The ink reservoir is configured to collapse in a controlled manner so that ink level can be inferred from an output signal from the sensor 82.

The outer shell 24 is preferably a bottle-shaped structure with an opening 88 for receiving a peripheral surface of the chassis 74. The outer shell 24 is fabricated using combined blow molding and injection molding. An exemplary material suitable for the outer shell 24 is polyethylene having a typical thickness of approximately 2 millimeters.

Figure 7:
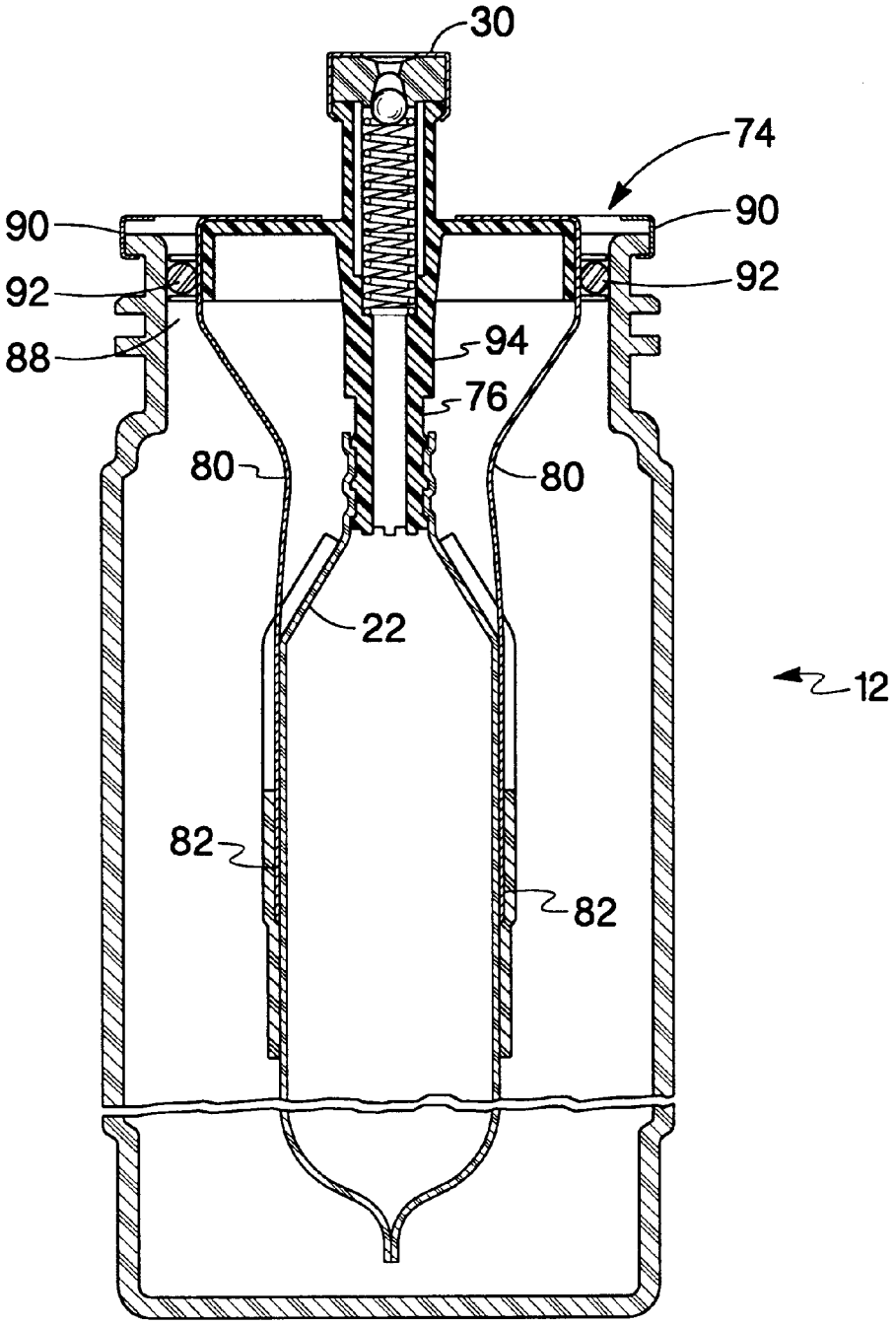
FIG. 7 depicts a section view of the ink container shown in FIG. 3 taken across line 7—7 shown in FIG. 6.
Figure 8:
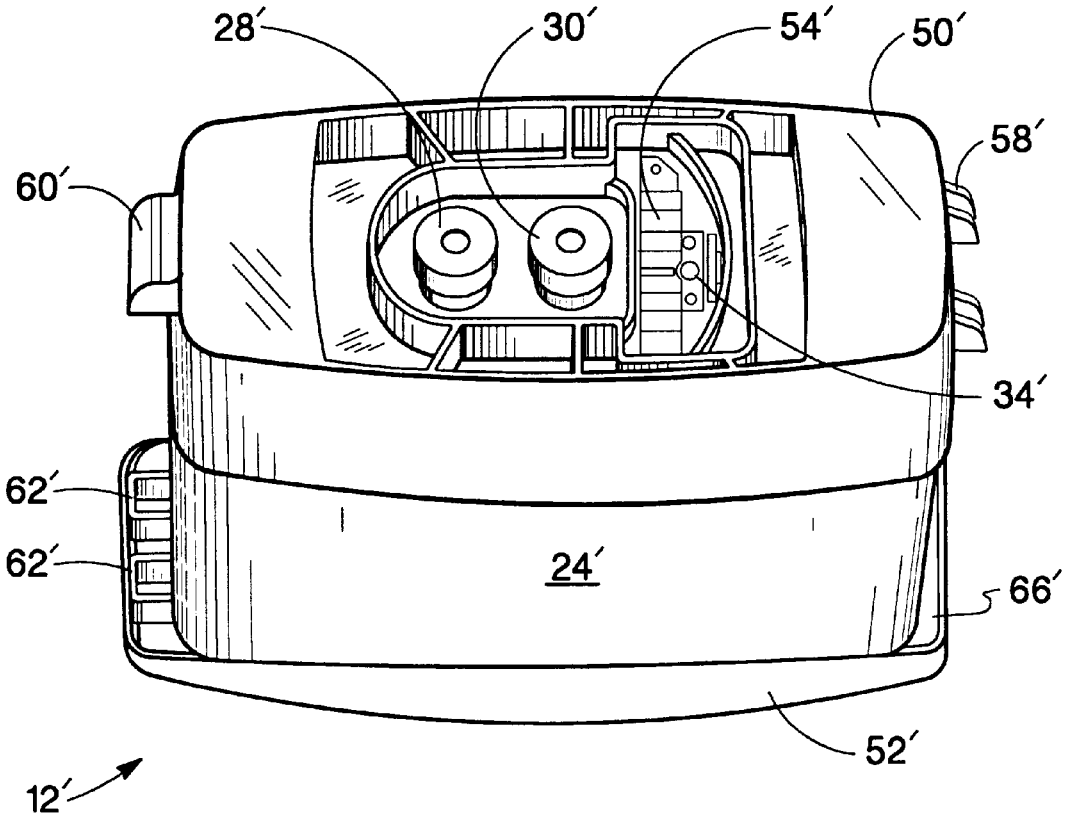
FIG. 8 depicts a perspective view of a leading edge portion of an alternative embodiment of the ink container of the present invention.

FIG. 7 depicts an assembled view of the ink container portion 12 shown in section taken across section lines 7—7 of FIG. 6. Chassis 74 is secured to a peripheral portion of the opening 88 in the outer shell 24 by a crimp ring 90. A compliant sealing member or o-ring 92 provides a seal between the chassis 74 and the inner surface of the outer shell 24. With the ink container 12 properly installed into the printer chassis 38, fluid communication is established between the printer portion and the ink reservoir 22 via the fluid outlet 30.

The air inlet 28 shown in FIG. 1 pressurizes the outer shell 24 that produces a force acting on the ink reservoir 22 tending to collapse the reservoir 22 and provide a pressurized source of ink from the fluid outlet 30. As ink is expelled from the fluid outlet 30, the spacing of the sensors 82 is altered. The sensors 82 provide a signal indicative of this spacing which is provided to the electrical contacts 54 shown in FIG. 6. The printing system 10 utilizes the information from the sensors 82 to determine remaining ink within the ink container 12.

An alternative embodiment of the ink container 12 will now be discussed with respect to FIGS. 8, 9A, 9B, 10, 11, 12 and 13. Similar numbering will used in FIGS. 8–13 to describe similar structures discussed previously with respect to FIGS. 1–7.

The alternative embodiment of the ink container 12' shown in FIGS. 8, 9A, 9B, 10, and 11B is similar to the ink container 12 shown in FIGS. 1–7 except that a non-circular opening is provided in the outer shell instead of a circular opening. It is preferred that this non-circular opening is elongated along an axis of elongation. The chassis then has a complimentary elongated shape to properly fit within the opening of the shell. The use of a non-circular opening or elongated opening and corresponding elongated chassis allows for the placement of interface features such as the air inlet, the fluid outlet and positioning of electrical contacts to be positioned on the chassis in the same spaced relationship while allowing the width or minor axis of the chassis to be significantly reduced. The reduction of the width of the chassis as well as the opening within the outer shell allows for a more compact ink container. By providing a more compact ink container the requirement for the ink container receiving station within the printing system is then reduced. These benefits will be discussed in more detail with respect to the discussions of FIGS. 8–13.

Figure 9A:
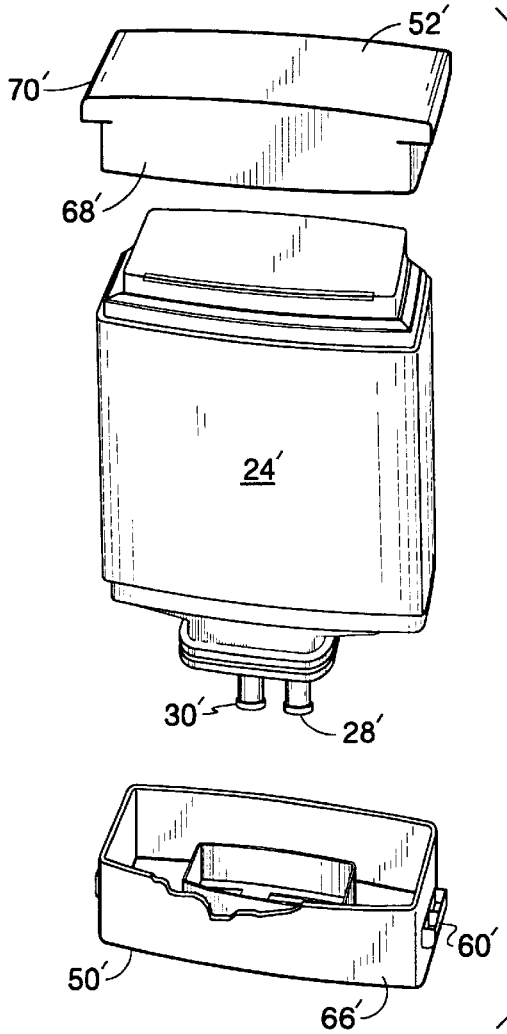
FIGS. 9A and 9B depicts a partially exploded view shown in perspective of the ink container shown in FIG. 8.
Figure 9B:
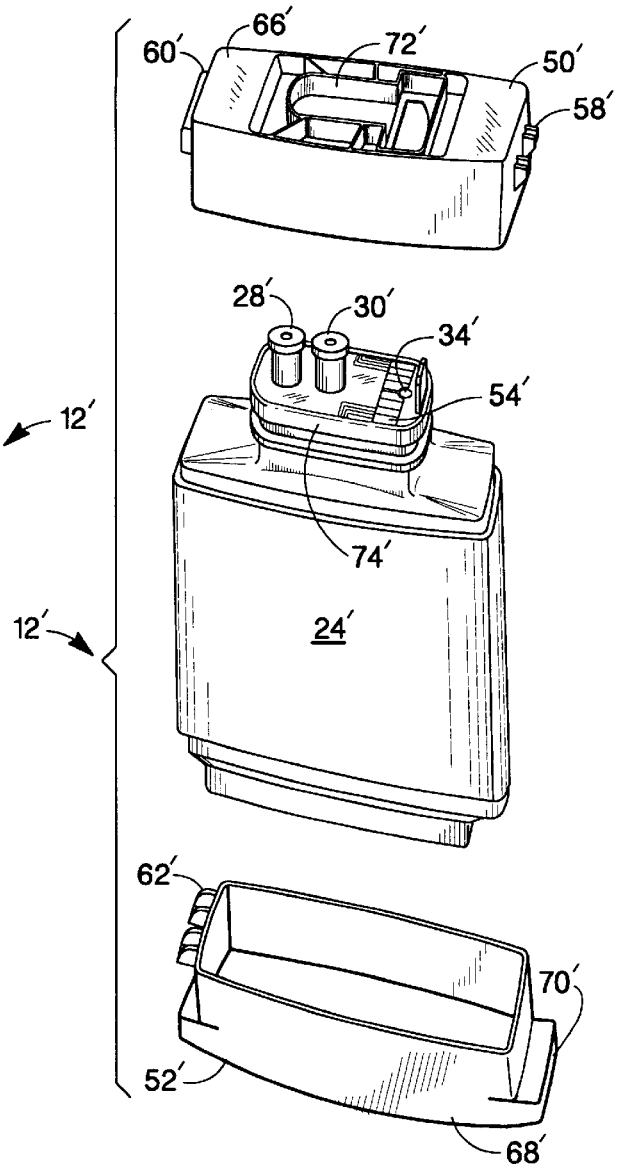

FIGS. 9A and 9B depicts a partially exploded view of the alternative embodiment of the ink container 12'. The ink container 12' shown in FIGS. 9A and 9B is similar to the ink container 12 shown in FIGS. 5A and 5B. The ink container 12' shown in FIGS. 9A and 9B is a partially exploded view showing a leading end cap 66' positioned at the leading edge 50' and a trailing end cap 68' positioned at the trailing end 52'. The leading end cap 66' includes a boss 72' for protecting the air inlet 28', fluid outlet 30', information storage device 34' and electrical contacts 54'.

The outer shell 24' has a non-circular opening therein. The chassis 74' has a non-circular shape that is complementary to the non-circular opening in the outer shell 24'. This non-circular shape allows the ink container 12' to have a reduced width dimension. This non-circular shape is preferably an elongate shape that allows each of the interface features such as the air inlet 28', the fluid outlet 30', and the electrical contacts 54' to be positioned in the same spaced orientation on the chassis 74' as the corresponding components 28, 30 and 54 for ink container 12. In addition this non-circular or elongate shape allows the width of the chassis 74' as well as the outer shell 24', leading edge cap 66' and trailing edge cap 68' to be reduced thereby providing an ink container that is more compact in at least one dimension. The non-circular ink container 12' will be discussed in more detail with respect to FIG. 11B.

Figure 10:
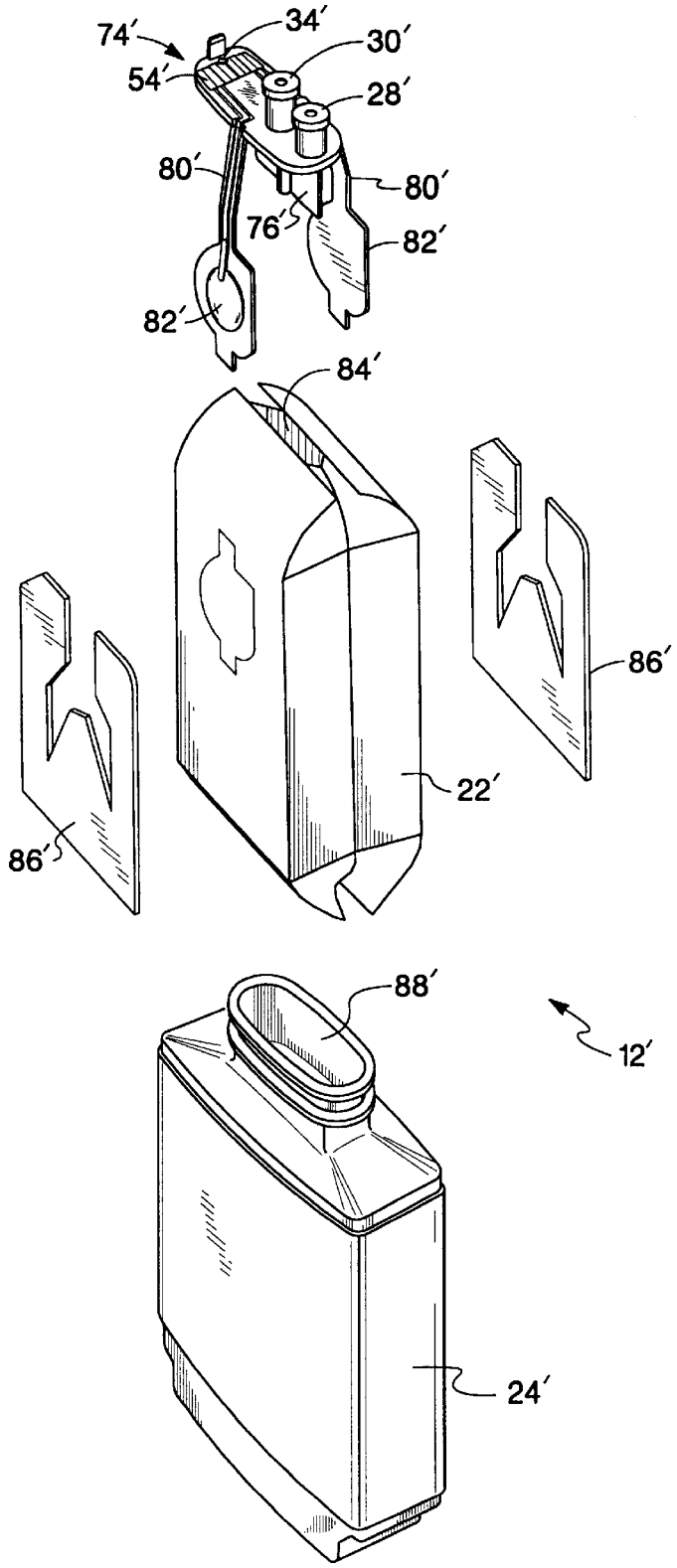
FIG. 10 depicts an exploded view shown in perspective of the ink container shown in FIG. 8.

FIG. 10 depicts an exploded view of the ink container 12' without the leading end cap 66' and the trailing end cap 68'. The ink container 12' includes the outer shell 24' that has a non-circular opening 88'. The opening 88' is preferably an elongate opening having an axis of elongation or a major axis and a minor axis. The chassis 74' is complimentary shaped to be received on a peripheral surface of the opening 88'. The chassis 74' includes the air inlet 28', the fluid outlet 30', electrical storage device 34', and electrical contacts 54'.

The chassis 74' contains interface features such as the air inlet 28', the fluid outlet 30', electrical storage device 34', and electrical contacts 54' for interfacing with corresponding features associated with the printer chassis 38. To ensure the ink container 12' properly engages corresponding interface features associated with the printer chassis 38 the chassis 74' should be a high precision part. The chassis 74' is attached to the outer shell 24' using a crimp cap 90' and o-ring seal in a manner similar to ink container 12 shown in FIG. 7.

Figure 11A:
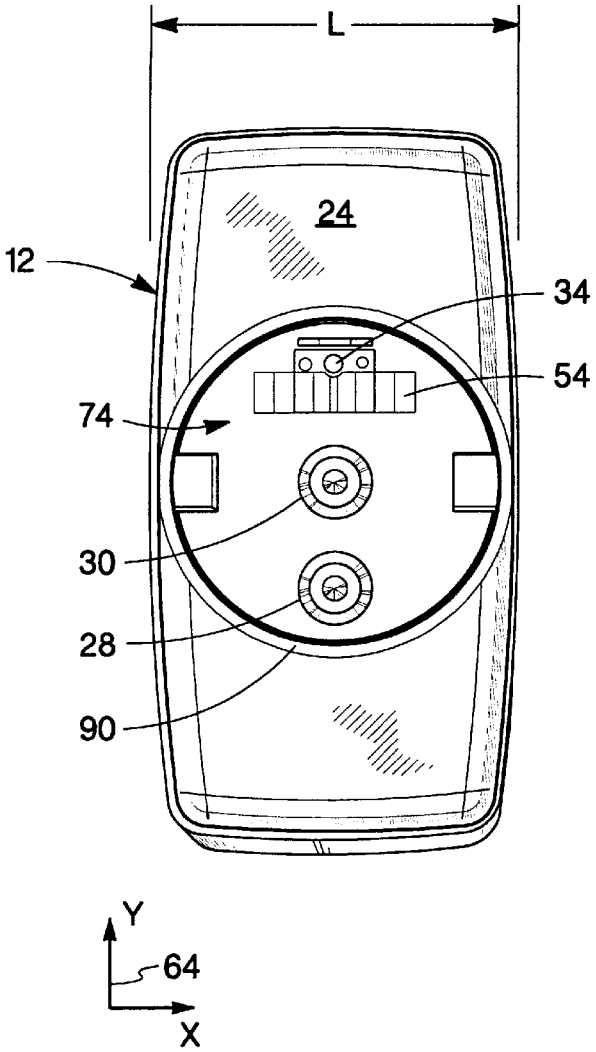
FIGS. 11A and 11B depicts a top plan view of the ink containers without the top cap portion shown in FIGS. 3 and 8, respectively.
Figure 11B:
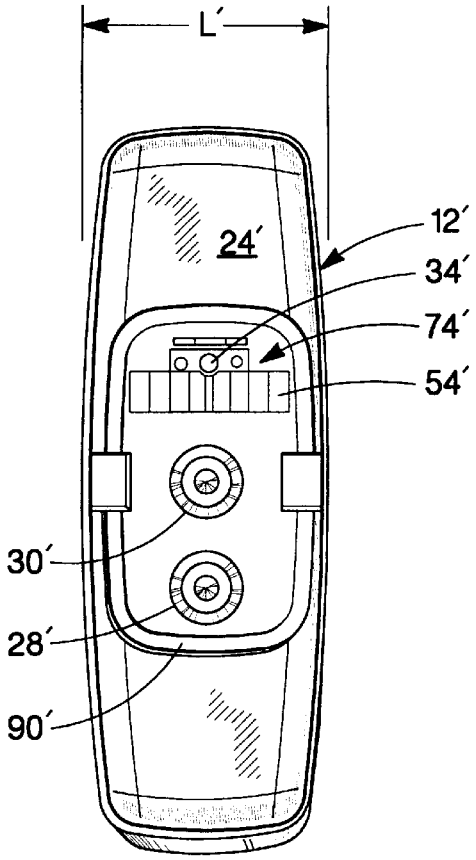
Figure 12:
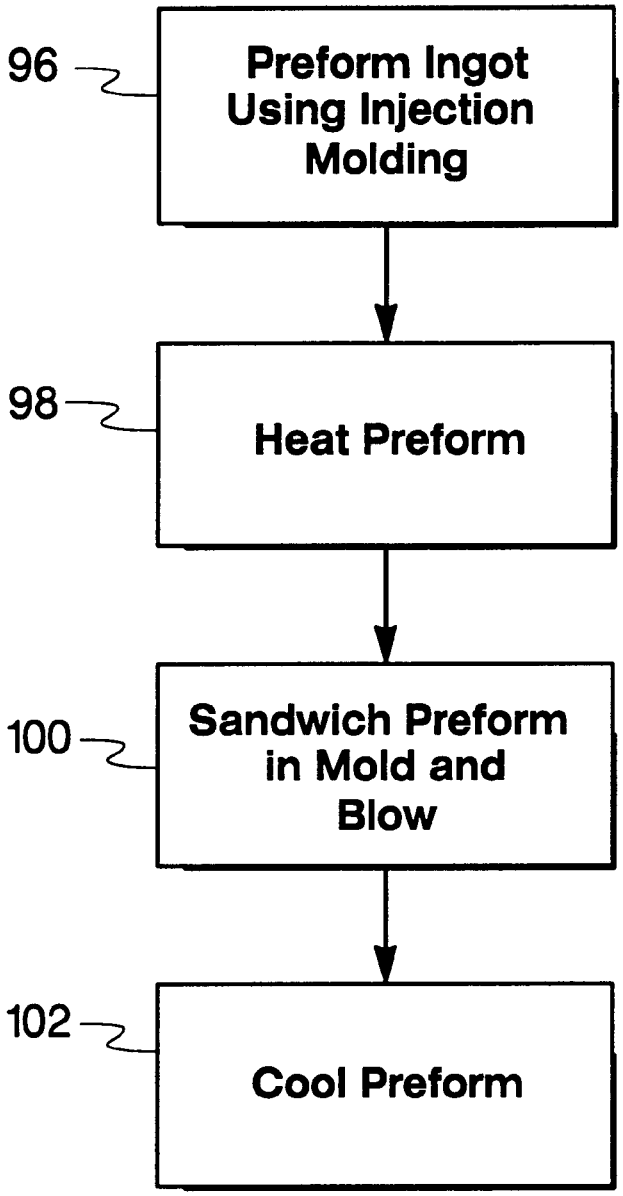
FIG. 12 depicts a method of the present invention for forming the ink container shown in FIG. 8.
Figure 13:
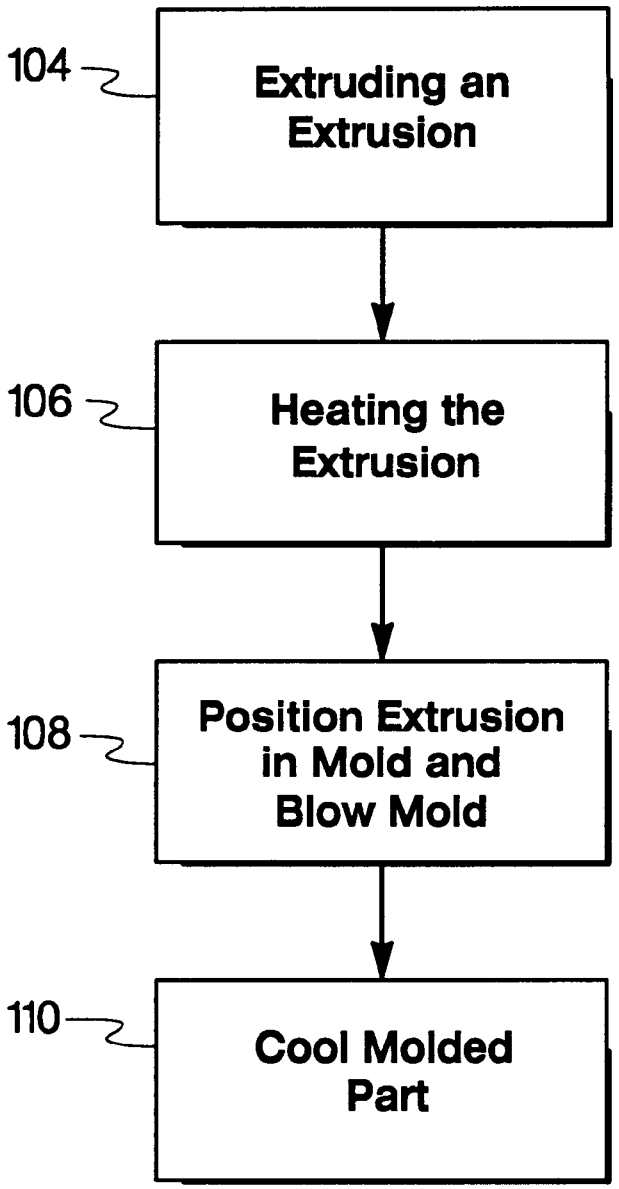
FIG. 13 depicts an alternative method of the present invention for forming the ink container shown in FIG. 8.

FIGS. 11A and 11B depict a leading edge view of the ink container 12 and ink container 12', respectively shown without leading end caps 66 and 66' respectively. The ink container 12 shown in FIG. 11A makes use of a circular opening in outer shell 24 as well as a complimentary circular chassis 74. In contrast, the ink container 12' makes use of an elongate opening in outer shell 24' as well as a complimentary shaped elongate chassis 74'. The spacing of interface features such as air inlet 28, fluid outlet 30, and electrical contacts 54 on the ink container 12 along the Y-axis in coordinate system 64 is substantially the same as the spacing of the corresponding features the air inlet 28', the fluid outlet 30', and the electrical contacts 54', respectively, associated with ink container 12'.

The ink container 12 has an outer shell 24 width measured along the X-axis in coordinate system 64 that is represented by length L. Similarly, the ink container 12' has an outer shell width measured along the X-axis represented by length L'. The width of ink container 12' represented by L' is significantly less than the width of ink container 12 represented by L. The use of a non-circular opening in the outer shell 24' allows the width of the ink container 12' to be significantly reduced while maintaining the same spacing of interface features such as the air inlet 28', the fluid outlet 30', and electrical interconnects 54'. By maintaining the same spacing of interface features 28', 30' and 54' the ink container 12' is plug compatible with the ink container 12.

Another aspect of the present invention is a method for forming the outer shell 24' of ink container 12'. A preform is first injection molded with a selected non-circular profile corresponding to the opening 88' of the outer shell 24' as represented by step 96. This preform is then heated until soft as represented by step 98. The preform is then positioned in a mold and blown as represented by step 100. The blown preform is then cooled as represented by step 102 and the mold is then removed.

An alternative method of the present invention makes use of an extrusion molding process than a blow molding process. The process includes extruding an extrusion from an extruder represented by step 104. The extruder is shaped such that the extrusion produced has a non-circular end portion. The extrusion is then heated as represented by step 106. The extrusion is then placed in a blow mold and blown so that the end portion forms the non-circular opening in the outer shell 24' as represented by step 108. Finally, the molded part is cooled as represented by step 110.

The present invention is a method and apparatus for forming an improved ink container that provides interface features for interfacing with fluid, air and electrical features on the printer chassis while providing a more narrow width than the circular chassis ink container. The non-circular chassis that makes use of a crimp cap to seal the chassis to the blow-molded bottle provides a relatively low cost and compact ink container. Previously used high volume manufacturing techniques for forming blowmolded bottles tend to make use of circular openings with threaded closures. Applicants have taken a fundamentally different approach from the previously used high volume bottle forming techniques by utilizing a non-circular bottle opening sealed with a crimp cap with an o-ring seal.

What is claimed is:

1. An ink container for providing ink to an ink jet printing system having a pressure source, the ink container comprising:

an outer shell having an interior region for containing a quantity of ink, the outer shell defining a non-circular elongate opening therein, the non-circular elongate opening having a length dimension and a width dimension wherein the length dimension is greater than the width dimension; and a chassis fabricated separately from the outer shell, the chassis having a fluid outlet and an air inlet defined therein, with the air inlet in communication with the pressure source and the fluid outlet in communication with the interior region which is fluidically coupled to the chassis, the chassis having a non-circular elongate shape that is in cross-section complementary with the non-circular elongate opening of the outer shell, with the chassis inserted into the outer shell pressurized air provided to the air inlet by the pressure source of the printing system pressurizes the interior region of the outer shell and pressurizes the quantity of ink to provide a source of pressurized ink at the fluid outlet.

2. The ink container of claim 1 further including an electrical storage device for storing information relating to the ink container, the electrical storage device having a plurality of electrical contacts associated therewith, the plurality of electrical contacts disposed and arranged on the chassis to engage corresponding electrical contacts associated with the ink jet printing system.

3. The ink container of claim 1 wherein the outer shell is a blow molded element.

4. The ink container of claim 1 wherein the outer shell is injection molded to define the non-circular elongated opening prior to blow molding.

5. The ink container of claim 3 wherein the outer shell is extrusion molded to define the non-circular elongate opening prior to blow molding.

6. The ink container of claim 1 wherein the non-circular elongate opening defines an axis of elongation that extends along the length dimension and wherein each of the fluid outlet and the air inlet are arranged along the axis of elongation.

7. The ink container of claim 6 further including an electrical storage device for storing information relating to the ink container, the electrical storage device having a plurality of electrical contacts associated therewith, the plurality of electrical contacts disposed and arranged on the chassis to engage corresponding electrical contacts associated with the ink jet printing system.

8. The ink container of claim 1 wherein the ink container is insertable into a printing chassis associated with the ink jet printing system, the printing chassis configured to receive a plurality of said ink containers with the plurality of said ink containers arranged in a side by side configuration with an axis of elongation for each ink container oriented in a common orientation.

9. An ink container for providing pressurized ink to an ink jet printing system having a pressure source, the ink container comprising:

a blow-molded outer shell having an interior region for containing a quantity of ink, the outer shell defining a non-circular elongate opening therein, the non-circular elongate opening having a length dimension and a width dimension wherein the length dimension is greater than the width dimension;

a crimp cap; and a chassis fabricated separately from the outer shell, the chassis having a fluid outlet and an air inlet defined therein, with the air inlet in communication with the pressure source and the fluid outlet in communication with the interior region which is fluidically coupled to the chassis, the chassis having a non-circular elongate shape that is in cross-section complementary with the non-circular elongate opening of the outer shell, with the chassis fastened to the non-circular elongate opening of the blow molded outer shell by the crimp cap pressurized air provided to the air inlet by the pressure source of the printing system pressurizes the interior region of the outer shell and pressurizes the quantity of ink to provide a source of pressurized ink at the fluid outlet.

10. The ink container of claim 9 further including a compressive o-ring disposed between the outer shell and the chassis for providing a seal between the chassis and the outer shell.

* * * * *